US007236132B1

(12) United States Patent
Lin et al.

(10) Patent No.: US 7,236,132 B1
(45) Date of Patent: Jun. 26, 2007

(54) COUPLED MULTI-BAND ANTENNA

(75) Inventors: Sheng-Chih Lin, Taipei Hsien (TW); Tsung-Wen Chiu, Taipei Hsien (TW); Fu-Ren Hsiao, Taipei Hsien (TW)

(73) Assignee: Advance Connectek Inc, Hsin-Tien (TW)

( * ) Notice: Subject to any disclaimer, the term of this patent is extended or adjusted under 35 U.S.C. 154(b) by 0 days.

(21) Appl. No.: 11/598,461

(22) Filed: Nov. 13, 2006

(30) Foreign Application Priority Data

Oct. 5, 2006 (TW) ..... 95137114 A

(51) Int. Cl.
*H01Q 1/24* (2006.01)

(52) U.S. Cl. ..... 343/700 MS; 343/702; 343/906; 343/846

(58) Field of Classification Search ..... 343/700 MS, 343/702, 906, 846; 333/24 C
See application file for complete search history.

(56) References Cited

U.S. PATENT DOCUMENTS 6,864,842 B2 * 3/2005 Hung et al. ..... 343/700 MS
6,992,627 B1 * 1/2006 Honda et al. ..... 343/700 MS
2005/0001766 A1 * 1/2005 Tasi ..... 343/700 MS

* cited by examiner

*Primary Examiner*—Tuyet Thi Vo
(74) *Attorney, Agent, or Firm*—Alan Kamrath; Kamrath & Associates PA

(57) ABSTRACT

A coupled multi-band antenna with the broadband function includes a coupled radiator, a feed wire, a first radiating extension, and a second radiating extension. The coupled radiator has a microwave substrate, a coupled metal element, a first radiating element, a second radiating element, and a connecting portion. The coupled metal element is connected to the positive terminal of the feed wire, and the second radiating element is connected to the negative terminal of the feed wire for the purposes of transmitting electrical signals and generating the multi-band operating modes of the antenna. By connecting the first and second radiating extensions to the coupled radiator, the surface current distribution and impedance variation of the antenna can be effectively adjusted to provide multi-band functions. The antenna utilizes the simple structure of coupled radiator to achieve multi-band operations and uses the radiating extensions to provide sufficient bandwidths.

6 Claims, 5 Drawing Sheets

COUPLED MULTI-BAND ANTENNA

BACKGROUND OF THE INVENTION

1. Field of the Invention

The invention relates to a coupled multi-band antenna and, in particular, to a multi-band antenna with the broadband function.

2. Description of Related Art

Personal mobile communications have proved its great potential and business opportunities in radio communication industry. During its evolution process, many systems have been developed, using different technologies and channels. They also play important roles in different areas and markets. However, such varieties cause troubles and inconvenience for both system suppliers and consumers. One crucial point is that different systems use different frequency bands (e.g., GSM900, PCS1900, and UMTS).

In order for users to operate with greater ease, the industry has invested a lot of manpower to develop products with multi-band integrations. However, the first difficulty to overcome is the antenna. One may say that the antenna is both the beginning and end of the wireless communications. Its properties directly affect the communication quality. An antenna has to satisfy the following requirements:

1. wide frequency and bandwidth; and
2. good matching between antenna radiation efficiency and field.

A recent trend in the design of electronic products is light and compact devices. This directly constrain the size of antenna inside the mobile communication products. Since the planar inverted-F antenna (PIFA) has an operating length of only ¼ wavelength, it is widely used in the designs of hidden small antennas. An example of the PIFA working at a single frequency in the prior art is given in U.S. Pat. No. 5,764,190. Afterwards, in order for the PIFA to work in multi-bands, the radiating elements are suggested to have L-shaped or U-shaped holes.

Another antenna that can achieve multi-band operations is illustrated in FIG. 1. The antenna has a first radiating part A, a second radiating part B, and a ground part C. The first radiating part A and the second radiating part B extend from the two opposite sides of one end of the ground part C. The first radiating part A includes a first conductive plate A1 and a first connecting part A2 connecting the first conductive plate A1 and the ground part C. The second radiating part B includes a second conductive plate B1 parallel to the ground part C and a second connecting part B2 connecting the second conductive plate B1 and the ground part C. The first conductive plate A1 and the second conductive plate B1 extend respectively from the first connecting part A2 and the second connecting part B2 toward the same direction.

Although the above-mentioned antenna can achieve multi-band operations, it nevertheless has the following drawbacks. The distance between the first conductive plate A1 and the second conductive plate B1 is too short, resulting in insufficient bandwidths in both high and low frequencies. Moreover, the small distance also causes large production errors in practice, lowering the yield. At the same time, the feed wire and the feed point are close to the first connecting part A2. Therefore, the bandwidth of the conventional PIFA has an upper limit, unable to achieve broadband effects.

To solve the above-mentioned problems, the invention proposes a novel design of coupled multi-band antenna with the broadband function. The disclosed antenna utilizes a coupled radiator to feed electrical signals into the antenna radiator in a coupled method. It avoids the drawback of a limited bandwidth in the conventional PIFA and reaches the goal of multi-band operations. Using two radiating extensions, the surface current distribution and impedance variation of the antenna can be effectively controlled to achieve broadband and higher radiation efficiency. Consequently, in addition to a novel structure, the disclosed antenna great enhances the bandwidth and efficiency and includes multiple system bands.

SUMMARY OF THE INVENTION

An objective of the invention is to provide a coupled multi-band antenna with the broadband function that, through the combination of a coupled antenna structure and two radiating extensions, achieves the broadband characteristic at high frequencies (1575~2500 MHz). This meets the broadband requirements of the GPS, DCS, PCS, UMTS, and Wi-Fi systems.

Another objective of the invention is to provide a coupled multi-band antenna with the broadband function that, through the combination of a coupled antenna structure and two radiating extensions, achieves the broadband characteristic at low frequencies (824~960 MHz). This meets the broadband requirements of the AMPS and GSM systems.

The above-mentioned objectives are implemented using the following technical features. The primary structure of the disclosed multi-band antenna includes a coupled radiator, a feed wire, a first radiating extension, and a second radiating extension. The coupled radiator is the primary radiator of the antenna that can operate at multiple bands. It has a microwave substrate, a coupled metal element, a first radiating element, a second radiating element, and a connecting portion. The coupled metal element is disposed on a surface of the microwave substrate, and connected to the positive signal wire of the feed wire. The first radiating element is also disposed on a surface of the microwave substrate, in the vicinity of the coupled metal element to form a coupled structure with a gap less than or equal to 3 mm. The second radiating element is disposed on a surface of the microwave substrate, and connected to the negative signal wire of the feed wire. Its extension direction is roughly parallel to the first radiating element. The connecting portion is disposed on a surface of the microwave substrate for an electrical connection between the first and second radiating elements. The first radiating element, the second radiating element, and the connecting portion of the coupled radiator form a resonant structure to generate the multi-band operating modes of the antenna. The electrical signal evenly feeds energy into the coupled radiator via the coupled structure of the coupled metal element and the first radiating element. By appropriately adjusting the width of the coupled metal element and the gap, one can achieve good impedance matching and multi-band operations.

Moreover, the first radiating extension and the second radiating extension are connected respectively to the first radiating element and the second radiating element. By changing the area of the two radiating extensions, the surface current distribution and impedance variation can be effectively adjusted so that the surface current distribution is more uniform and the impedance variation becomes smoother. The invention utilizes the simple of a coupled radiator to achieve multi-band operations. The use of radiating extensions renders larger bandwidths for the disclosed multi-band antenna. Therefore, the invention can meet the requirements of multiple system bands.

DETAILED DESCRIPTION OF THE PREFERRED EMBODIMENT

Figure 1:
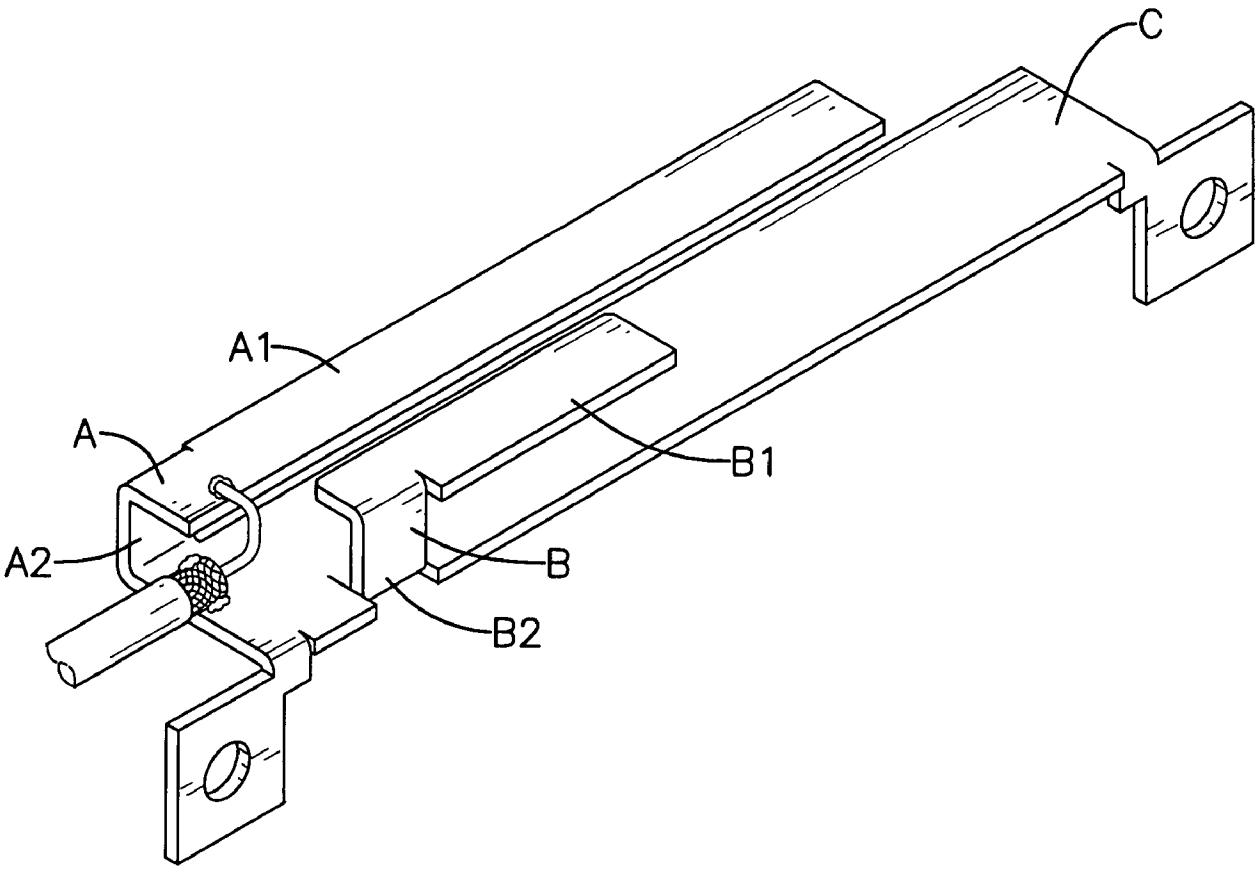
FIG. 1 PRIOR ART
FIG. 1 is a perspective view of the conventional multi-band antenna.
Figure 2:
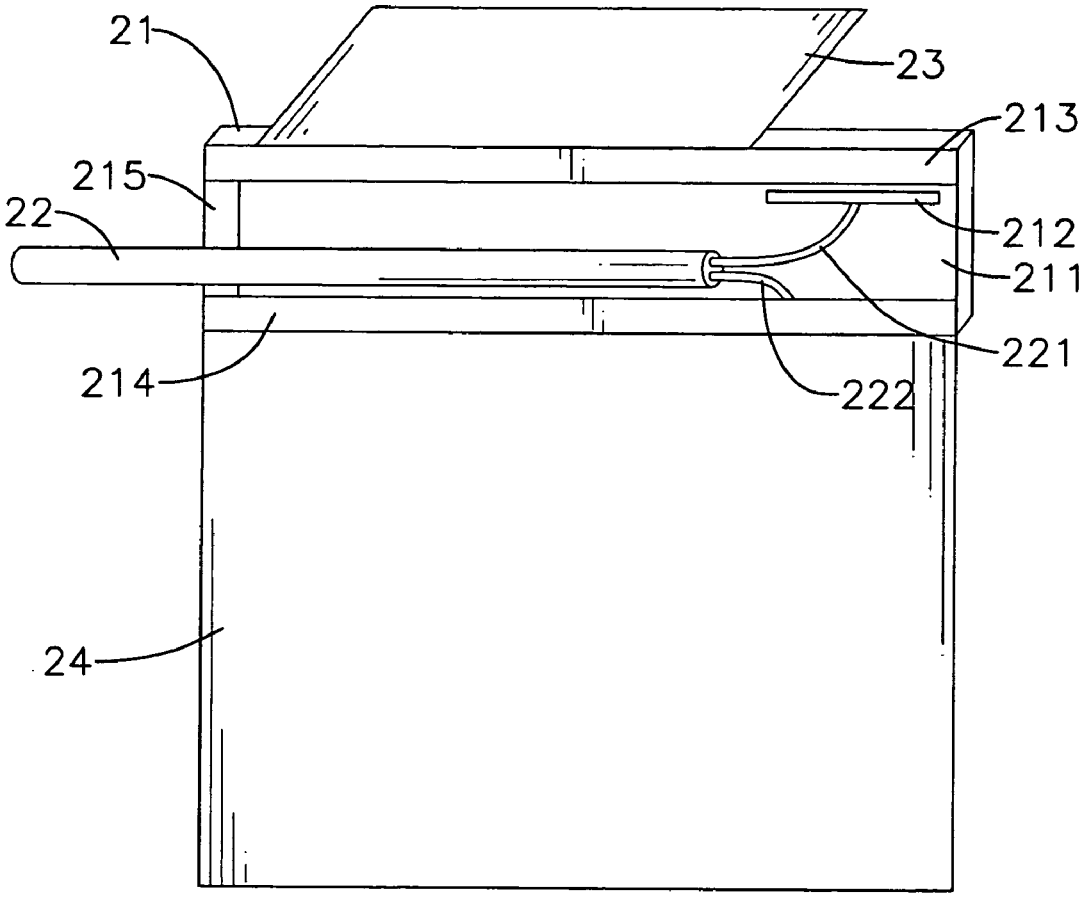
FIG. 2 is a perspective view of the antenna according to the first embodiment of the invention.

The first embodiment of the coupled multi-band antenna is shown in FIG. 2. The antenna includes a coupled radiator 21, a feed wire 22, a first radiating extension 23, and a second radiating extension 24. The coupled radiator 21 has a microwave substrate 211, a coupled metal element 212, a first radiating element 213, a second radiating element 214, and a connecting portion 215. The coupled metal element 212 is disposed on one surface of the microwave substrate 211. The first radiating element 213 is disposed on one surface of the microwave substrate 211 and in the vicinity of the coupled metal element 212 to form a coupled structure with a gap less than or equal to 3 mm. The second radiating element 214 is disposed on one surface of the microwave substrate 211, and its extension direction is roughly parallel to the first radiating element 213. The connecting portion 215 is disposed on one surface of the microwave substrate 211, and its both ends are connected respectively to the first radiating element 213 and the second radiating element 214. The feed wire 22 is used to transmit high-frequency signals. It has a positive signal wire 221 and a negative signal wire 222. The positive signal wire 221 is electrically connected to the coupled metal element 212. The negative signal wire 222 is electrically connected to the second radiating element 214. The first radiating extension 23 is electrically connected to the first radiating element 213, and has an area larger than that of the first radiating element 213. The second radiating extension 24 is electrically connected to the second radiating element 214, and has an area larger than that of the second radiating element 214. The coupled structure of the coupled radiator 21 can generate the multi-band operating modes. By appropriately adjusting the coupling gap between the coupled metal element 212 and the first radiating element 213, the signal is evenly fed into the coupled radiator 21 to achieve good impedance matching and multi-band operations. By changing the areas of the first and second radiating extensions, the surface current distribution and impedance variation of the antenna can be effectively adjusted so that the current distribution is more uniform and the impedance variation becomes smoother. The invention thereby achieves broadband operating characteristics and good radiation efficiency.

Figure 3:
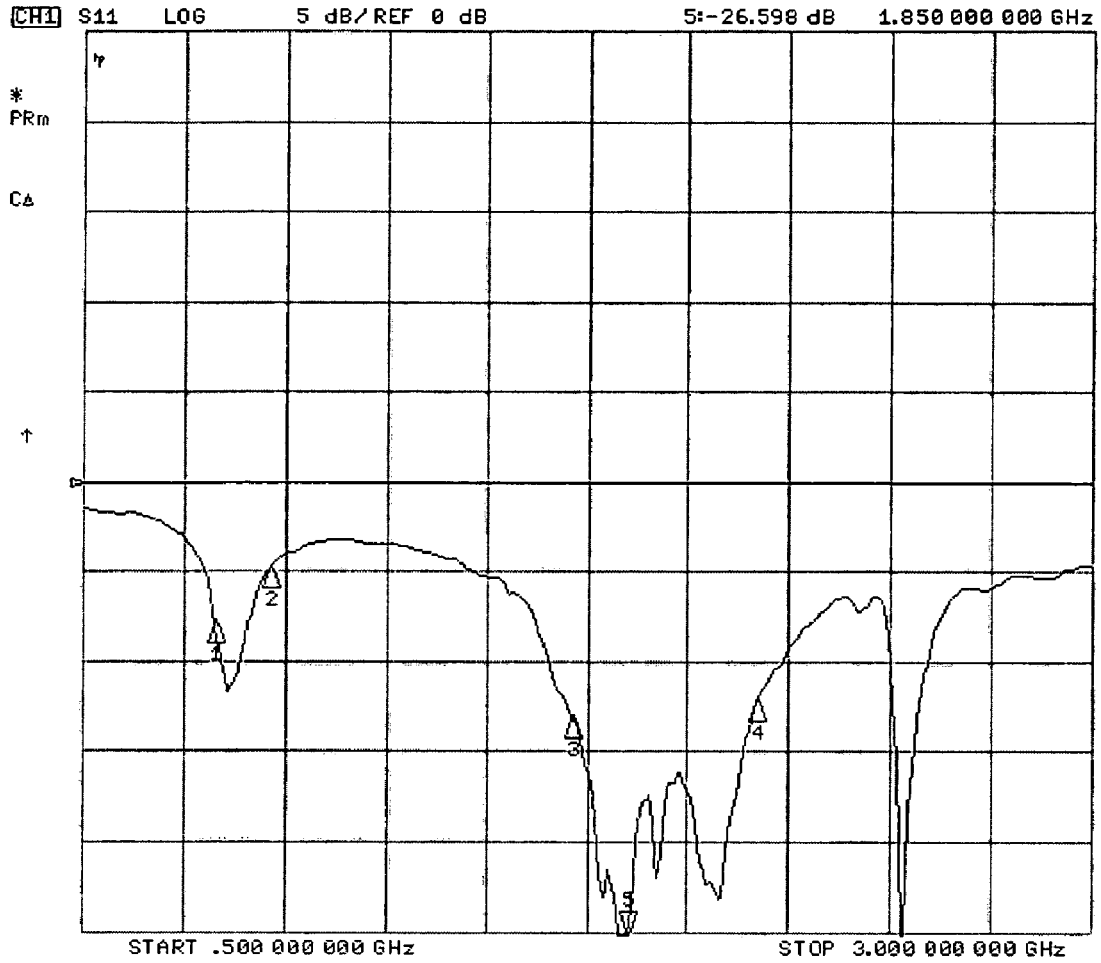
FIG. 3 is a return loss plot for the antenna in the first embodiment.

FIG. 3 shows the measurement of the return loss for the signal in the first embodiment of the coupled multi-band antenna of the invention. The bandwidth of the disclosed antenna at low-frequency modes 31 covers the AMPS (824~894 MHz) and GSM (880~960 MHz) systems. Its bandwidth at high-frequency modes covers the GPS (1575 MHz), DCS (1710~1880 MHz), PCS (1850~1990 MHz), UMTS (1920~2170 MHz), and Wi-Fi (2400~2500 MHz) systems. Therefore, the antenna has superior operating properties.

Figure 4:
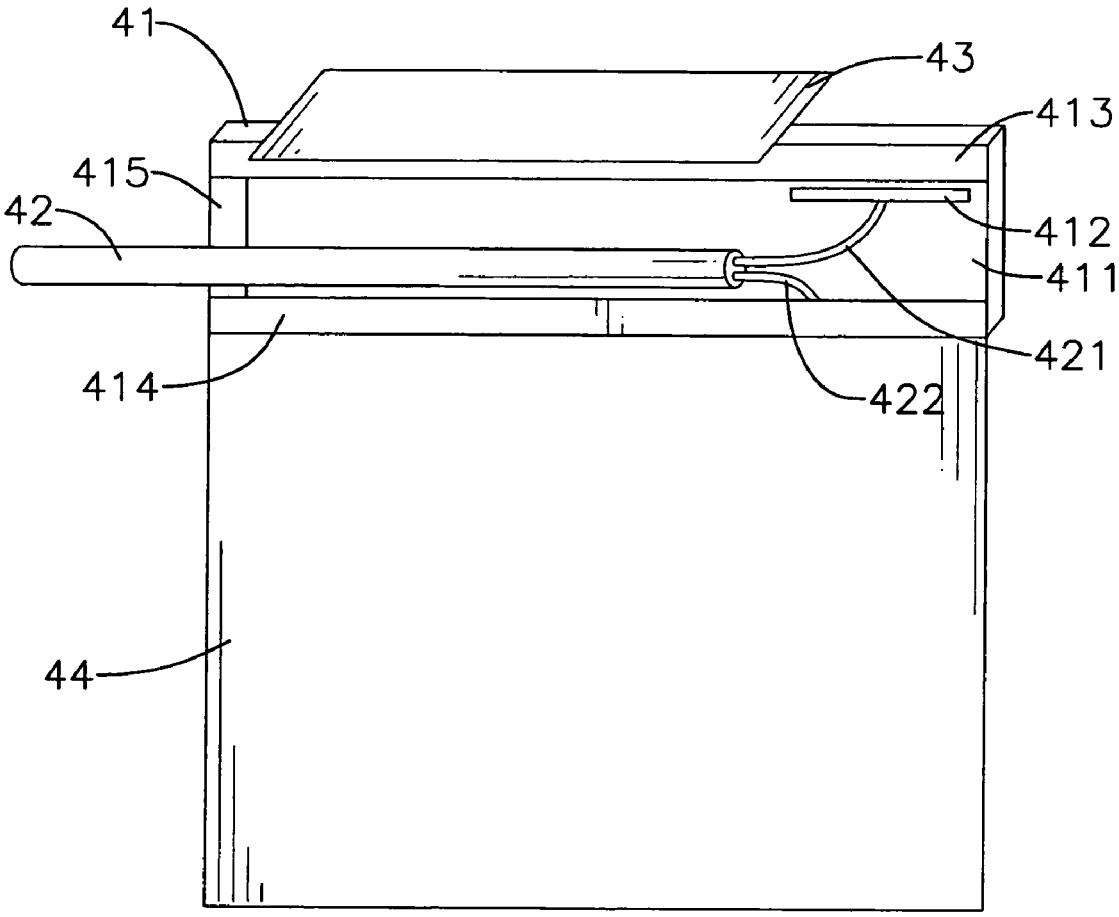
FIG. 4 is a perspective view of the antenna according to the second embodiment of the invention.

The second embodiment of the disclosed coupled multi-band antenna is shown in FIG. 4. It includes a coupled radiator 41, a feed wire 42, a first radiating extension 43, and a second radiating extension 44. The coupled radiator 41 has a microwave substrate 411, a coupled metal element 412, a first radiating element 413, a second radiating element 414, and a connecting portion 415. The coupled metal element 412 is disposed on one surface of the microwave substrate 411. The first radiating element 413 is disposed on one surface of the microwave substrate 411 and in the vicinity of the coupled metal element 412 to form a coupled structure with a minimal gap less than 3 mm. The second radiating element 414 is disposed on one surface of the microwave substrate 411, and its extension direction is roughly parallel to the first radiating element 413. The connecting portion 415 is disposed on one surface of the microwave substrate 411, and its both ends are connected respectively to the first radiating element 413 and the second radiating element 414. The feed wire 42 is used to transmit high-frequency signals. It has a positive signal wire 421 and a negative signal wire 422. The positive signal wire 421 is electrically connected to the coupled metal element 412. The negative signal wire 422 is electrically connected to the second radiating element 414. The first radiating extension 43 is electrically connected to the first radiating element 413, and has an area larger than that of the first radiating element 413. The second radiating extension 44 is electrically connected to the second radiating element 414, and has an area larger than that of the second radiating element 414. The coupled structure of the coupled radiator 41 can generate the multi-band operating modes. By appropriately adjusting the coupling gap between the coupled metal element 412 and the first radiating element 413, the signal is evenly fed into the coupled radiator 41 to achieve good impedance matching and multi-band operations. By changing the areas of the first and second radiating extensions, the surface current distribution and impedance variation of the antenna can be effectively adjusted so that the current distribution is more uniform and the impedance variation becomes smoother. The invention thereby achieves broadband operating characteristics and good radiation efficiency.

Figure 5:
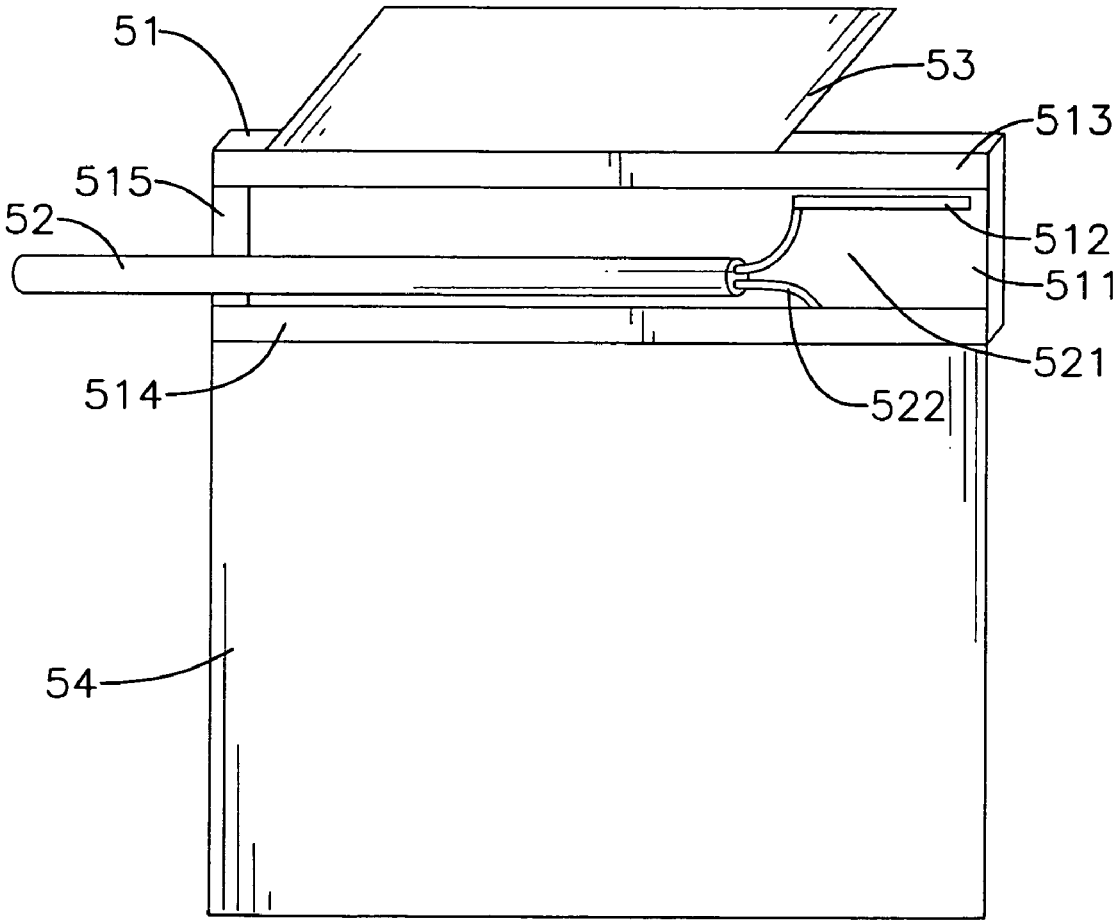
FIG. 5 is a perspective view of the antenna according to the third embodiment of the invention.

The third embodiment of the disclosed coupled multi-band antenna is shown in FIG. 5. It includes a coupled radiator 51, a feed wire 52, a first radiating extension 53, and a second radiating extension 54. The coupled radiator 51 has a microwave substrate 511, a coupled metal element 512, a first radiating element 513, a second radiating element 514, and a connecting portion 515. The coupled metal element 512 is disposed on one surface of the microwave substrate 511. The first radiating element 513 is disposed on one surface of the microwave substrate 511 and in the vicinity of the coupled metal element 512 to form a coupled structure with a gap less than or equal to 3 mm. The second radiating element 514 is disposed on one surface of the microwave substrate 511, and its extension direction is roughly parallel to the first radiating element 513. The connecting portion 515 is disposed on one surface of the microwave substrate 511, and its both ends are connected respectively to the first radiating element 513 and the second radiating element 514. The feed wire 52 is used to transmit high-frequency signals. It has a positive signal wire 521 and a negative signal wire 522. The positive signal wire 521 is electrically connected to the coupled metal element 512. The negative signal wire 522 is electrically connected to the second radiating element 514. The first radiating extension 53 is electrically connected to the first radiating element 513, and has an area larger than that of the first radiating element 513. The second radiating extension 54 is electrically connected to the second radiating element 514, and has an area larger than that of the second radiating element 514. The coupled structure of the coupled radiator 51 can generate the multi-band operating modes. By appropriately adjusting the coupling gap between the coupled metal element 512 and the first radiating element 513, the signal is evenly fed into the coupled radiator 51 to achieve good impedance matching and multi-band operations. By changing the areas of the first and second radiating extensions, the surface current distribution and impedance variation of the antenna can be effectively adjusted so that the current distribution is more uniform and the impedance variation becomes smoother. The invention thereby achieves broadband operating characteristics and good radiation efficiency.

The connections between the components 23, 43, 53 and the components 213, 413, 513 are not limited to the edge-to-edge example disclosed herein. Moreover, the component 221 can be connected to any point on the component 212.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A coupled multi-band antenna comprising:

a coupled radiator comprising:

a microwave substrate;

a coupled metal element located on the microwave substrate;

a first radiating element located on the microwave substrate and adjacent to the coupled metal element;

a second radiating element located on the microwave substrate and whose extension direction is parallel to the first radiating element; and a connecting portion located on the microwave substrate and having two ends connected respectively to the first radiating element and the second radiating element;

a feed wire comprising a positive signal wire connected to the coupled metal element and a negative signal wire connected to the second radiating element;

a first radiating extension connected to the first radiating element; and a second radiating extension connected to the second radiating element.

2. The coupled multi-band antenna as claimed in claim 1, wherein the coupled metal element is separated from the first radiating element by a gap less than or equal to 3 mm.

3. The coupled multi-band antenna as claimed in claim 1, wherein the first radiating extension is lager than the first radiating element in area.

4. The coupled multi-band antenna as claimed in claim 1, wherein the second radiating extension is lager than the second radiating element in area.

5. The coupled multi-band antenna as claimed in claim 1, wherein the feed wire is used to transmit high-frequency signals.

6. The coupled multi-band antenna as claimed in claim 1, wherein the first and second metal extensions are used to increase the antenna bandwidth and radiation efficiency.

* * * * *